United States Patent [19]

Yang

[11] 4,058,085

[45] Nov. 15, 1977

[54] STAMP PAD

[76] Inventor: Teh-Tsao Yang, 696, Section 4, Pa-Teh Road, Taipei, China /Taiwan

[21] Appl. No.: 633,430

[22] Filed: Nov. 19, 1975

[51] Int. Cl.[2] ..... B05C 11/00

[52] U.S. Cl. ..... 118/264

[58] Field of Search ..... 118/264, 268, 269; 15/104.92; 220/DIG. 26; 206/18

[56] References Cited

U.S. PATENT DOCUMENTS

| | | | |
|---|---|---|---|
| 425,834 | 4/1890 | Sword | 118/268 |
| 1,690,275 | 11/1928 | Coryell | 220/DIG. 26 |
| 1,709,182 | 4/1929 | McKnight | 220/DIG. 26 |
| 3,669,071 | 6/1972 | Gates | 118/264 |

*Primary Examiner*—John P. McIntosh

[57] ABSTRACT

A hi-fi stamp pad comprising a pad vessel, a substrate whereupon a kind of fiber is vertically planted and thus a flock surface formed thereon, a bolster which is buried under the substrate and contained in the pad vessel whereby to hold ink for stamp use, and a ringlet compulsively rounded the inner brink of the pad vessel to set steadily the substrate upon the bolster. Being first filtered through the substrate, the ink is absorbed upward from the bolster by the flock and accordingly, appropriately wets the flock surface thereof. Once a stamp or seal touches the flock surface, the latter brushes the ink evenly upon the engraved character surface and breaks the ink surface tension built thereupon whereby to regulate the ink adhesion and to make the stamped characters very clear.

3 Claims, 4 Drawing Figures

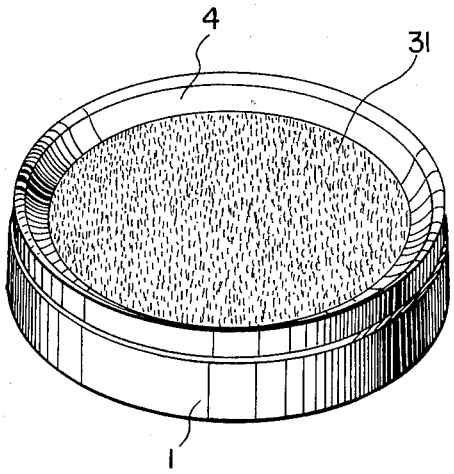
Fig. 3.
Fig.2a.
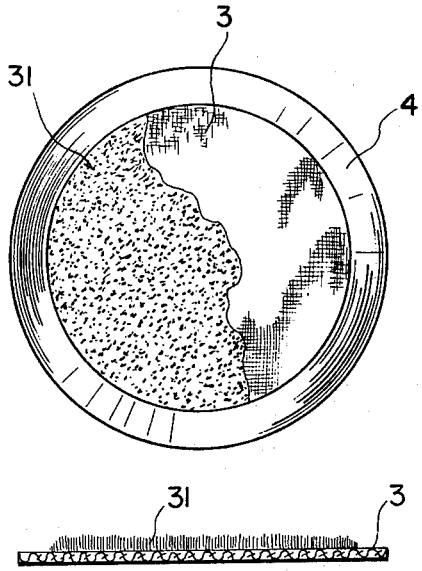
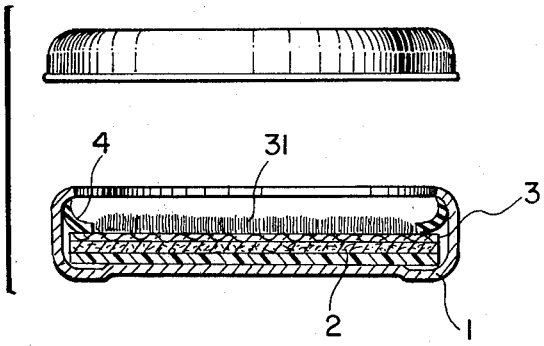
Fig.1.
Fig.2b.

STAMP PAD

BACKGROUND OF THE INVENTION

1. Field of the Invention

This invention relates to a stamp pad.

2. Brief Description of the Prior Art

A conventional seal or stamp pad using silk, batting, sponge or felt to soak the ink and cloth to form the pad surface always jams the engraved characters with dusts and wastes, and as a result the character surface can not adhere the ink so properly as to obtain a clear stamp or seal.

BRIEF SUMMARY OF THE INVENTION

The object of the present invention is to obviate the disadvantages stated hereabove by providing a novel stamp pad wherein the pad surface is made of a substrate with flock perpendicularly planted thereon to brush ink evenly upon the character surface and haul out the dusts and wastes jammed in and on the engraved characters thereof during working in order to obtain a seal or stamp of high fidelity after printing.

BRIEF DESCRIPTION OF THE DRAWINGS

The object, advantages and function of the present invention will be made apparent from the following detailed description of the preferred embodiment with reference to the accompanying drawings where:

FIG. 1 is a sectional view of a stamp pad according to the present invention with lid;

FIG. *2a* shows a plan view of the stamp pad with partial sections of the substrate and flock.

FIG. *2b* shows a cross-sectional view of the substrate with flock.

FIG. 3 is a perspective view of a possible example according to the present invention.

DETAILED DESCRIPTION OF THE PREFERRED EMBODIMENTS

Referring to FIG. 1, the stamp pad according to the present invention comprises a pad vessel 1, a bolster 2 contained in said pad vessel 1 soaking and holding ink for stamp use, a substrate 3 with flock 31 perpendicularly planted thereon to form the pad surface, and a ringlet 4 compulsively rounded the inner brink of said pad vessel 1 to steadily fix said substrate 3 on the said bolster 2.

Said bolster 2 made of silk, cotton, sponge, felt and the like serves basically as an ink container and a support of the pad surface. The said flock 31, consisted of fibers, closely and perpendicularly planted on said substrate 3, absorbs the ink upward due to capillarity through the filtering of said substrate 3 and therefore, is evenly and properly humidified thereby. Once a stamp or seal presses upon the pad surface, three effects occur simultaneously:

1. the said flock 31 brushes ink evenly on the stamp character surface;

2. the said flock 31 breaks the ink surface tension, which usually causes superficious adhesion of ink on the character surface, so that the ink is properly spreaded on the latter thereof; and 3. the said flock 31 with spiny surface hauls out the dusts and wastes jammed in and on the engraved characters making the latter neat and clear.

As a result, upon printing, a beautiful stamp or seal of high-fidelity surely can come out.

FIGS. *2a* and *2b* shows in detail the said substrate 3 with said flock 31 perpendicularly planted thereon. The definition of said substrate with flock planted thereon should not be confined in a narrow sense, any kind of layers alternatively exploited, irrespectively as to whether said bolster is presented or not, to let the flock penetrate out is to be included therein.

FIG. 3 is a perspective view of a possible example according to the present invention.

I claim:

1. A stamp pad comprising:

a. a pad vessel having a ring-shaped upturned edge;

b. a bolster contained in said pad vessel for soaking and holding ink for stamp use;

c. a substrate with flock perpendicularly planted thereon to form the pad surface placed on top of said bolster in said vessel, said flock drawing ink from said bolster upward through said substrate by capillary action and retaining said ink, said ink being filtered by said substrate, said flock being evenly wetted thereby, said surfae being formed so that when a stamp or seal presses upon said pad surface said flock brushes ink evenly on the stamp character surface and breaks the ink surface tension avoiding superficious adhesion of ink on the stamp surface, said flock forming a spiny surface to clean out the dust and waste jammed in and on the engraved characters allowing the printing of a neat and clear seal; and d. a ringlet forced under compression into said ring-shaped upturned edge of said pad vessel to retain said substrate on said bolster.

2. A stamp pad according to claim 1, wherein said flock consists of a kind of fiber, and said substrate a kind of textile.

3. A stamp pad according to claim 1, wherein said pad vessel, said bolster, and said substrate are disc-shaped.

* * * * *